United States Patent [19]

Genakis

[11] Patent Number: 4,932,229

[45] Date of Patent: Jun. 12, 1990

[54] CYLINDER LOCK

[76] Inventor: Joseph M. Genakis, 949 W. Boylston St., Worcester, Mass. 01606

[21] Appl. No.: 59,307

[22] Filed: Jun. 8, 1987

[51] Int. Cl.[5] ..... E05B 27/04

[52] U.S. Cl. ..... 70/494; 70/378

[58] Field of Search ..... 70/358, 364 A, 378, 70/376–377

[56] References Cited

U.S. PATENT DOCUMENTS

| | | | |
|---|---|---|---|
| 457,753 | 8/1891 | Taylor | 70/378 |
| 3,349,587 | 10/1967 | Keller | 70/358 |
| 3,499,302 | 3/1970 | Spain | 70/364 A |
| 3,731,507 | 5/1973 | Wolter | 70/358 |
| 3,987,654 | 10/1976 | Iaccino | 70/364 A |
| 4,103,526 | 8/1978 | Surko | 70/364 A |
| 4,450,699 | 5/1984 | Genakis | 70/364 A |

*Primary Examiner*—Robert L. Wolfe

*Attorney, Agent, or Firm*—John E. Toupal; Harold G. Jarcho

[57] ABSTRACT

A cylinder lock in which at least one tumbler assembly includes a pin tumbler supported for rotational movement about its axis within a tumblerway, a driver, and a coupling mechanism releaseably coupling the driver to the pin tumbler for rotational movement of the driver about its axis in response to said rotational movement of the pin tumbler. The coupling mechanism at least partially defines a split line along which the pin tumbler and the driver may separate when the one tumbler assembly is axially and rotationally positioned relative to a plug and a shell in a predetermined releasing position wherein the split line is aligned with a shear line between the plug and the cylinder, and the pin tumbler has means for positioning the one pin tumbler assembly in the releasing position in response to engagement with a proper key in a keyway through the plug. A cavity is defined by the plug and is arranged to receive a portion of the coupling mechanism during relative movement of the plug out of a locked position, and a driver limit limits rotational movement of the driver in the tumblerway.

7 Claims, 5 Drawing Sheets

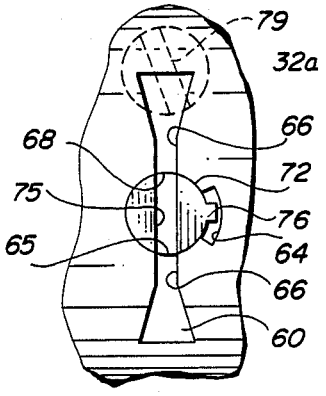
FIG. 18
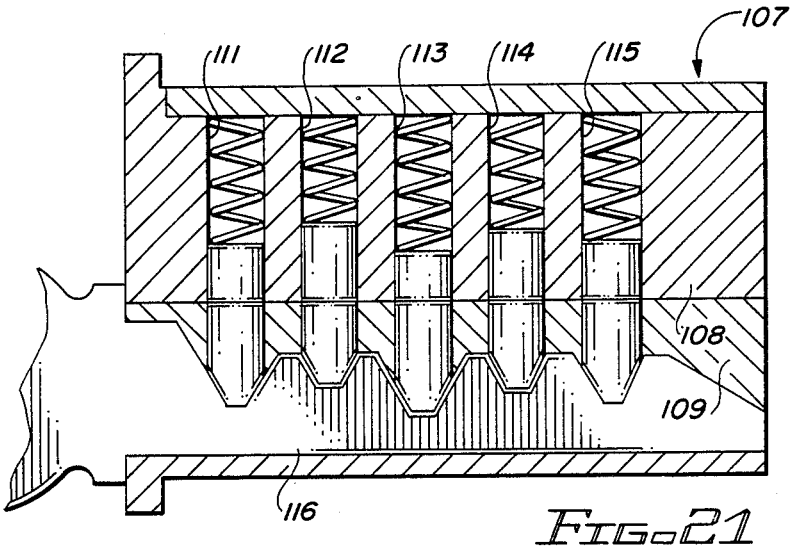
FIG. 21
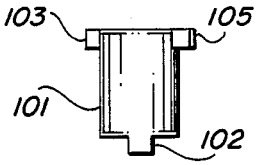
FIG. 19
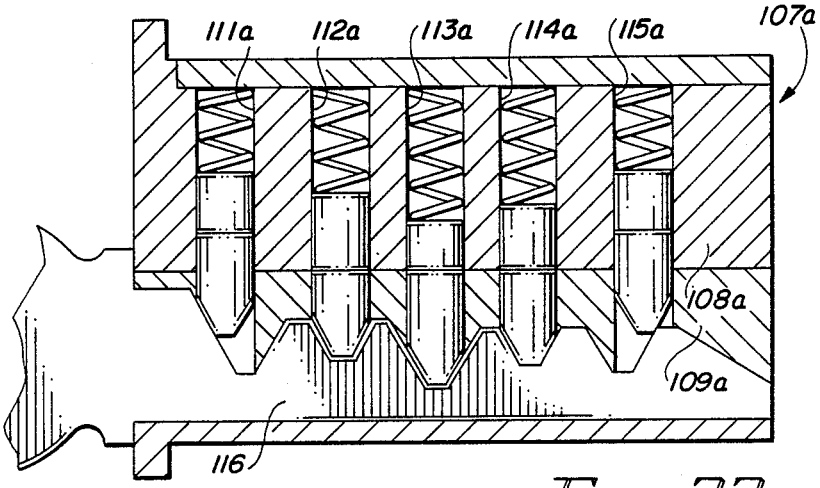
FIG. 22
FIG. 20
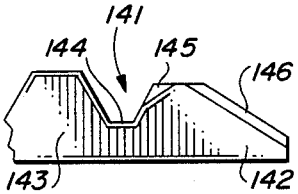
FIG. 25
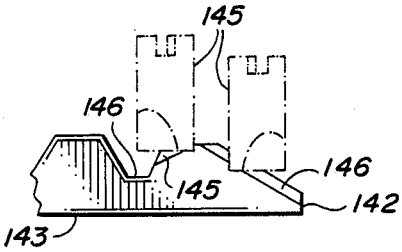
FIG. 28
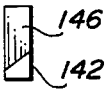
FIG. 26
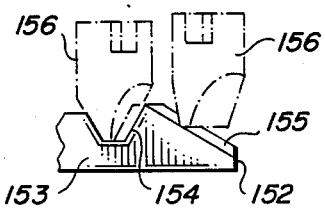
FIG. 30
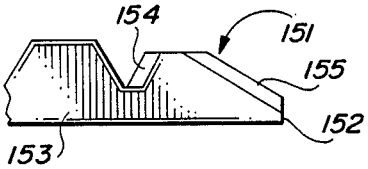
FIG. 29
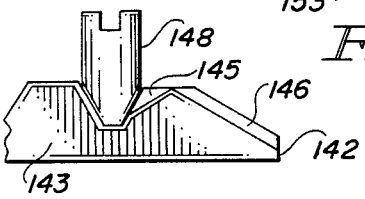
FIG. 27

CYLINDER LOCK

BACKGROUND OF THE INVENTION

This invention relates generally to a cylinder lock and, more particularly, to a cylinder lock having pin tumblers axially and rotationally controlled by a proper key.

The advent of both axially and rotationally controlled pin tumblers substantially increased the degree of security and number of key changes possible for cylinder locks. Typical dual control cylindrical locks are disclosed, for example, in U.S. Pat. Nos. 3,499,302; 3,722,240; 3,837,197; 4,098,103 and 4,103,526. Although such locks provide significant functional advantages over prior cylinder locks, a need exists for further improvements in both the degree of security and possible key changes that can be provided by a cylinder lock. Another system for increasing possible key changes is disclosed in U.S. Pat. No. 3,349,587. The lock described in that patent changes the spacing between tumblerways to increase the number of available locking combinations. However, the disclosed structure and key bitting technique provide a lock which is easily violated and difficult to produce. According to the patent, each lock requires for opening a uniform degree of axial movement of all its tumblers and, therefor, a proper key with bits of equal depth.

The object of this invention, therefore, is to provide an improved dual control cylinder lock that offers greater security and key change possibilities than are presently available with locks of that type.

SUMMARY OF THE INVENTION

The invention is an improved cylinder lock in which at least one tumbler assembly includes a pin tumber supported for rotational movement about its axis within a tumblerway, a driver, and a coupling mechanism releaseably coupling the driver to the pin tumbler for rotational movement of the driver about its axis in response to said rotational movement of the pin tumbler. The coupling mechanism at least partially defines a split line along which the pin tumbler and the driver may separate when the one tumbler assembly is axially and rotationally positioned relative to a plug and a shell in a predetermined releasing position wherein the split line is aligned with a shear line between the plug and the cylinder, and the pin tumbler has means for positioning the one pin tumbler assembly in the releasing position in response to engagement with a proper key in a keyway through the plug. A cavity is defined by the plug and is arranged to receive a portion of the coupling mechanism during relative movement of the plug out of a locked position, and a driver limit limits rotational movement of the driver in the tumblerway. Provision of a rotational limit insures a proper alignment of the coupling mechanism upon return of the plug to its locked position.

According to certain features of the invention, the driver limit comprises an engagement surface defined by an axial slot in the tumblerway, and a stop surface defined by a tab projecting transversely from the driver, received by the slot, and engageable with the slot in response to a predetermined limited extent of axial rotation of the driver. The slot and tab efficiently provide the rotational limit function.

According to other features, the cavity is a chordal groove defined by an outer surface and the plug, intersecting the tumblerway and having outwardly flared ends and a central portion intersected by the tumblerway. The groove guides a portion of the driver into position for recoupling with the pin tumbler.

In one embodiment of the invention the coupling mechanism comprises a master pin coupled between the driver and the pin tumbler and at least partially defining therewith an auxiliary split along which the pin tumbler and the master pin may separate when the one tumbler assembly is axially and rotationally positioned relative to the plug and the shell in a given releasing position different than the predetermined releasing position and the auxiliary split line is aligned with the shear line. The master pin coupling mechanism provides the lock with master keying capability.

In another embodiment of the invention, the lock includes a fence member retained by the plug, biased into engagement with the shell and blockingly associated with the pin tumbler; the fence being shaped and arranged such that rotation of the pin tumbler into the predetermined releasing position allows the fence to clear the shear line. A fence member in combination with a dual controlled coupled driver and pin tumbler assembly provides a lock with significantly enhanced security.

According to features of the above embodiment, the pin tumbler defines a change gate for receiving a projection of the fence when in the predetermined releasing position, the coupling mechanism comprises a master pin between the driver and the pin tumbler and at least partially defining therewith an auxiliary split along which the pin tumbler and the master pin may separate when the one tumbler assembly is axially and rotationally positioned relative to the plug and the shell in a given releasing position different than the predetermined releasing position and the auxiliary split line is aligned with the shear line, and the pin tumbler further defines a master gate spaced from the change gate and adapted to receive the projection of the fence when in the given releasing position. Provision of a master gate on the pin tumbler increases the master key change possibilities of the lock.

According to another feature the lock includes a proper key having a central portion disposed between head and nose portions, the head portion adapted to be manually manipulated and the central and nose portions adapted to enter the keyway, and wherein the central portion defines a plurality of bits for simultaneously engaging all of a plurality of pin tumblers and each having an elevation and lateral orientation required to move its engaged pin tumbler into its releasing position, and the nose portion defines contact surface means adapted to sequentially engage and insure sequential rotational movements of each pin tumbler into both clockwise and counter clockwise positions in response to entry and removal of the key from the keyway. The contact surface means on the key nose further ensures proper alignment of the coupling mechanism.

According to another feature of the above embodiment, there is provided a common non-uniform longitudinal spacing between a plurality of tumblerways of the lock and between a plurality of projections on the fence. The use of common non-uniform spacing between tumblerways and fence projections provide a highly secure lock with an extremely large number of possible key changes.

The invention further encompasses a multiple series of substantially identical cylinder locks in which movement of each lock to its unlocked position requires different degrees of axial movement by certain ones of its tumbler assemblies, the combination of axial movements required of the tumbler assemblies in each lock of each series to effect movement thereof into its unlocked position is different than the combination of axial tumbler assembly movements required for all other locks in the series to effect movement thereof into their unlocked positions; the longitudinal spacings between tumblerways of each lock in each series is the same as the longitudinal spacings between tumblerways of all other locks in the series; and the longitudinal spacing between tumblerways of the locks in each series is different than the longitudinal spacing between tumblerways of the locks in all other series. The use of non-uniform spacing between tumblerways permits an increase in possible key changes.

According to one feature of the above invention, the longitudinal spacing between tumblerways in each lock of the series is different than the longitudinal spacing of all other locks of the series. Different tumblerway spacing requires a differently bitted key for each lock of the series.

The invention further encompasses a method of producing a cylindrical lock of the above type and in which driver pins are provided with a plurality of a distinct driver stops each for providing a different limitation on rotational movement of the driver pin within a tumblerway and including the steps of removing from each of the driver pins all except one of the steps particularly related to an associated pin tumbler.

DESCRIPTION OF THE DRAWINGS

These and other objects and features of the invention will become more apparent upon a perusal of the following description taken in conjunction with the accompanying drawings wherein:

FIG. 18 is a fragmentary top view illustrating operation of the lock in FIG. 6;

FIG. 19 is a side view of a modified driver pin;

FIG. 20 is a top view of the driver pin shown in FIG. 19;

FIG. 21 is a schematic cross-sectional view of another cylinder lock embodiment;

FIG. 22 is a schematic cross-sectional view of a modification of the lock shown in FIG. 21;

FIG. 25 is a fragmentary side view of a key according to the invention;

FIG. 26 is an end view of the key shown in FIG. 25;

FIGS. 27 and 28 are fragmentary views illustrating operation of the key shown in FIG. 25;

FIG. 29 is a fragmentary view of another key modified by the key shown in FIGS. 27 and 28; and FIG. 30 is a fragmentary view illustrating operation of the key shown in FIG. 29.

DESCRIPTION OF THE PREFERRED EMBODIMENTS

Figure 5:
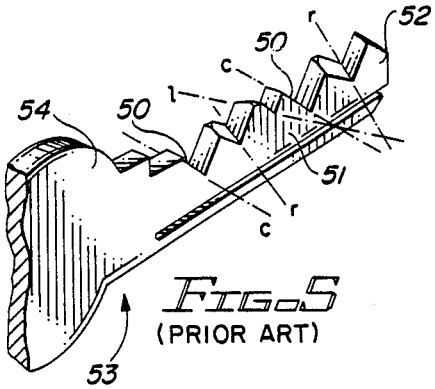
FIG. 5 (PRIOR ART)
FIG. 5 is a schematic perspective view of a key for use with a lock in FIG. 1.
Figure 2:
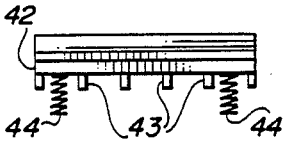
FIG. 2 (PRIOR ART)
FIGS. 2–4 are schematic top, side and end views, respectively, of a fence member shown in FIG. 1.
Figure 3:
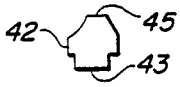
FIG. 3 (PRIOR ART)
Figure 4:
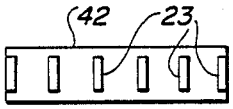
FIG. 4 (PRIOR ART)

FIGS. 1–5 illustrate a conventional cylinder lock 31 commonly known as a Medeco lock. A cylindrical plug 32 is accommodated by a bore in a cylindrical shell 33 and can be rotated therein between locked and unlocked positions. Defined by the plug 32 are a plurality of longitudinally distributed plug tumblerways 34 that intersect a keyway 35. The cylinder 33 also defines a plurality of longitudinally spaced apart shell tumblerways 36 that are aligned with the plug tumblerways 34. Received by each pair of plug and shell tumblerways is a tumbler assembly consisting of a pin tumbler 37, a driver pin 38 and a bias spring 39. A cam member 41 is fixed for rotation with an end of the plug 32 opposite to the entry of the keyway 35. Also defined by the plug 32 is a longitudinal recess that accommodates a sidebar fence 42 having leg projections 43 disposed in alignment with the pin tumblers 37. A pair of bias springs 44 urge the sidebar 42 outwardly so as to produce engagement between an outer cam surface 45 thereof and an inner surface of the shell 33.

In the absence of a proper key within the keyway 35, the springs 39 bias the driver pins 38 and pin tumblers 37 into axial positions wherein split lines therebetween are not aligned with the radial shear line between the outer surface of the plug 32 and the inner surface of the shell 33 to thereby prevent relative rotation therebetween. In addition, the rotational positions of the pin tumblers 37 are such as to blockingly engage the sidebar legs 43. That engagement maintains interference between the cam surface 45 and the shell 33 and thereby further restricts rotation of the plug 32. However, after entry of a central portion 51 and a nose portion 52 of a proper key 53 into the keyway 35, a head portion 54 can be manipulated to rotate the plug 32 within the shell 33 into an unlocked position. The central portion 51 of the key 53 possesses a plurality of longitudinally distributed bits 50 that engage wedge shaped ends 55 of the pin tumblers 37 and moves them into positions that permit rotational movement of the plug 32. The elevations of the bits are such as to move the tumbler assemblies into axial positions wherein the split lines between the driver pins 38 and the pin tumblers 37 are aligned with the shear line between the outer surface of the plug 32 and the inner surface of the shell 33. In addition, the bits 50 are cut selectively with transverse angular orientations of either center (c), right (r) or left (l) that rotate the pin tumblers 37 into center, clockwise or counter clockwise rotational positions wherein longitudinal slots 56 therein receive the sidebar leg projections 43. Accordingly, unrestricted engagement between the cam surface 45 and the inner surface of the shell 33 cams the sidebar 42 inwardly to allow rotation of the plug 32. This operation of the locks 31 is well known and is more fully disclosed in the prior art such as U.S. Pat. No. 3,499,302.

Figure 6:
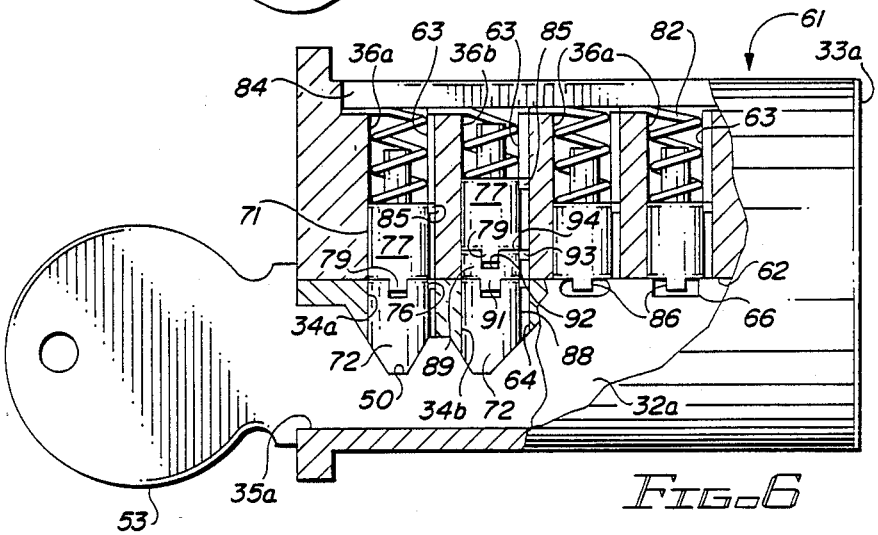
FIG. 6 is a schematic portional cross-sectional view of a cylinder lock according to the invention.
Figure 7:
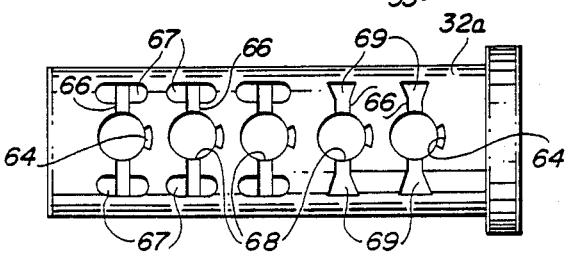
FIGS. 7 and 8 are schematic top and side views, respectively, of the lock shown in FIG. 6.
Figure 8:
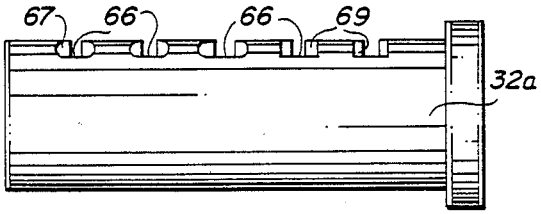

Referring now to FIGS. 6–11, there is shown a cylinder lock 61 constructed according to the present invention. Component parts of the cylinder lock 61 that are similar to those of the lock 31 shown in FIGS. 1–5 bear related reference numerals. A cylindrical plug 32*a* is rotatably mounted within a longitudinal bore of a shell 33*a* so as to define therebetween a radial shear line 62. Defined by the plug 32*a* are longitudinally spaced apart, radial plug tumblerways 34*a*, 34*b* that intersect a keyway 35*a* and are aligned with, respectively, shell tumblerways 36*a*, 36*b* defined by the shell 33*a*. Intersecting and parallel to the plug tumblerways 34*a*, 34*b* are axial tumbler engagement limit slots 64 that are aligned with axial driver engagement limit slots 63 that intersect and are parallel to the shell tumblerways 36*a*, 36*b*. As shown in FIGS. 7 and 8 an outer surface of the plug 32*a* also defines a plurality of chordal grooves 66 having opposite outwardly flared ends 67, 69 and inner ends 68 that intersect the plug tumblerways 34*a*, 34*b*. Also shown in FIGS. 7 and 8 are chordal grooves 66 with modified outwardly flared ends 69, it being understood that in any specific lock, grooves with only one of the end types 67 or 69 normally would be employed.

Disposed for axial and rotational movement in each pair of the aligned tumblerways 34*a*, 36*a*, is a change key responsive tumbler assembly 71, shown more clearly in FIGS. 9–12. The tumbler assembly 71 includes a pin tumbler 72 having a bottom wedge shaped end 73 for engaging a central portion 51 of a proper key and a top end 74 interrupted by a transverse coupling slot 75. Extending from the outer surface of the pin tumbler 72 is a tumbler limit tab 76 that is accommodated by a limit slot 64 in the plug tumblerway 34*a*. Also included in the assembly 71 is a driver pin 77 with a bottom end 78 having a transverse coupling ridge 79 that is received by and mated to the transverse slot 75 in the pin tumbler 72. The top end of the driver pin 77 terminates with a bifurcated stem 81 that retains one end of a torsional bias spring 82, the opposite end of which is retained by a slot 83 (FIG. 10) in a shell cover member 84. Projecting from the outer surface of the driver pin 77 is a driver limit tab 85 that is accommodated by a driver limit slot 63 in a tumblerway 36*a*. Together, the transverse slot 75 and the transverse ridge 79 form between the driver pin 77 and the tumbler pin 72 a coupling that provides common rotation thereof. A split line 86 between the pins 72 and 77 includes a pin portion between the pin ends 74 and 78 and a coupling portion between the transverse slot 75 and the transverse ridge 79.

Referring again to FIG. 6, the aligned tumblerways 34*b* and 36*b* retain a modified tumbler assembly 88 for accommodating a master key. In the assembly 88, rotational coupling between the pin tumbler 72 and the driver pin 77 is provided by a master pin 89. A transverse rib 91 on the bottom of the master pin 89 accommodates the transverse slot 75 in the pin tumbler 72 and together they provide a separate split line. Receiving the transverse rib 79 on the driver pin 77 is a transverse slot 92 in the upper end of the master pin 89 and together they form an auxiliary separable split line 94. Projecting from the outer surface of the master pin 89 is a master limit tab 93 that is movable axially in the limit slots 63 and 64.

Figure 9:
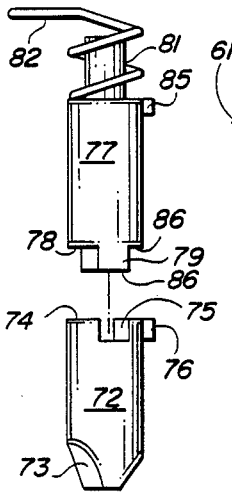
FIG. 9 is an exploded view of a tumbler assembly for the lock shown in FIG. 6.
Figure 10:
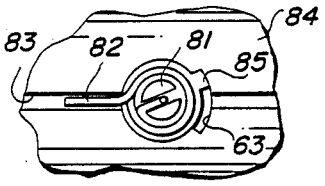
FIG. 10 is a schematic top view of the tumbler assembly shown in FIG. 9.
Figure 14:
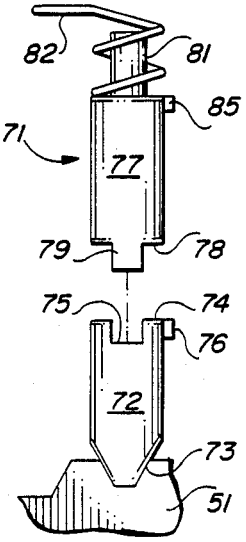
FIG. 14 is an exploded view of the tumbler assembly of FIG. 9 in a releasing position.
Figure 11:
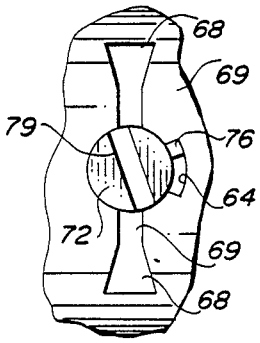
FIGS. 11 and 12 are fragmentary top and side views, respectively, of the assembly shown in FIG. 9.
Figure 15:
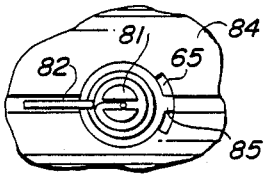
FIG. 15 is a schematic top view of the tumbler assembly shown in FIG. 14.

In the absence of a proper key in the keyway 35*a*, the springs 82 bias the assemblies 71 and 88 into axial positions wherein the split lines between, respectively, the driver pins 77 and either the pin tumblers 72 or the master pin 89 do not coincide with the shear line 62 between the plug 32*a* and the shell 33*a*. Accordingly, rotation is of the plug 32*a* within the shell 33*a* is prevented. In addition, the spring 82 exerts a torsional bias that retains the assemblies 71 in selected relative rotational positions such as shown in FIGS. 9 and 10. Those positions are established by engagement between the limit tab 85 on the driver pin 77 and one sidewall engagement surface of the limit slot 63. With those relative rotational positions of the assemblies 71, the transverse ridges 79 on the driver pins 77 are misaligned with the chordal grooves 66 creating an interference that further prevents rotation of the plug 32*a* in the shell 33*a*. In a similar manner, the assembly 88 is retained in an axial position that misaligns the shear line 62 with the split lines between the master pin 89 and either the pin tumbler 72 or the driver pin 77 and in a relative rotational position that misaligns the transverse ridges 79 and 91 on, respectively, the driver pin 77 and the master pin 89 with an associated chordal grooves 66 as shown in FIG. 11.

Figure 13:
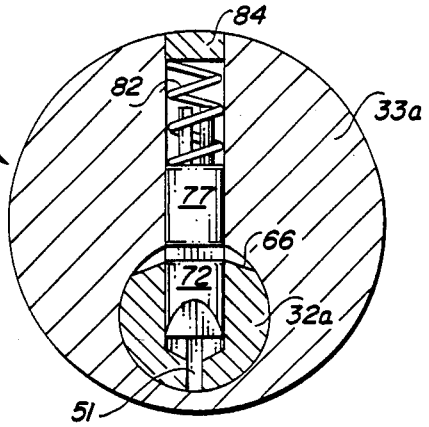
FIG. 13 is a schematic cross-sectional view of the lock of FIG. 6 with a plug in a locked position.
Figure 13A:
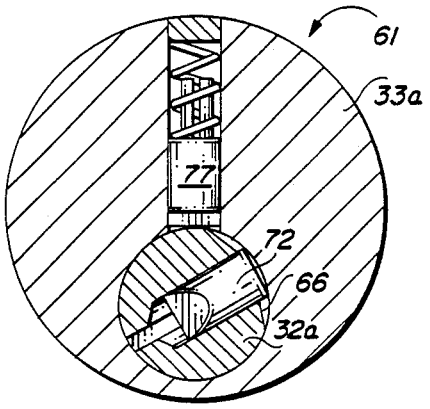
FIG. 13*a* is a schematic cross-sectional view of the lock shown in FIG. 6 with the plug rotated toward an opened position.
Figure 12:
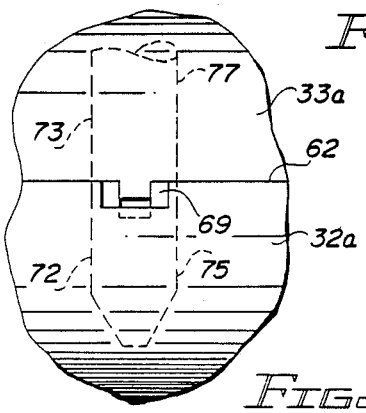

The entry of a properly bitted change key into the keyway 35*a* moves the assemblies 71 into axial positions as shown in FIGS. 6, and 12–13 wherein pin portions of the split lines 86 between the driver pins 77 and the pin tumblers 72 are aligned with shear line 62. In addition, the assemblies 71 are rotated into rotational positions wherein the transverse ridges 79 on the driver pins 77 are aligned with the chordal grooves 66 as shown in FIGS. 6, and 12. Similarly, the assembly 88 is moved into an axial position wherein the split line between the master pin 89 and the pin tumbler 72 is aligned with the shear line 62 and into a rotational position wherein the transverse ridge 91 on the master pin 89 is aligned with a chordal groove 66. With the tumbler assemblies 71 and 88 in those relative positions, the plug 32*a* is free to rotate into an open position within the shell 33*a*. During this rotation of the plug 32*a*, the transverse ridges 79 and 91 initially pass through aligned choral grooves 66 before engaging and being driven upwardly against the bias springs 82 by the outer surface of the plug 32 as shown in FIGS. 12 and 13*a*.

During rotational movement of the plug 32*a*, the relative rotational positions of the pin tumblers 72 are retained by engagement of their bottom wedge shaped ends 73 with the bits 50 on the central portion 51 of the change key 53. Thus upon return of the plug 32*a* to its locked position, the transverse slots 75 in the pin tumblers 72 will be in alignment with the chordal grooves 66. The driver pins 77, however, having been decoupled from the pin tumblers 72 are free to rotate under the influence of the springs 82 into positions wherein the transverse ridges 79 can be misaligned with the chordal grooves 66. The degree of that misalignment, however, is limited by engagement between the limit tabs 85 on the driver pins 77 and the limit slots 63 in the tumblerways 36a, 36b. That limit on rotational movement insures for the transverse ridges 79 a rotational orientation that permits entry into an outwardly flared portion 69 of a chordal groove 66 as shown in FIG. 18. After entering the enlarged outer portion 69 of a groove 66, the transverse ridges 79 and 91 are guided thereby into alignment and engagement with the transverse slots 75 in the pin tumblers 72.

The lock 61 also can be operated by a master key (not shown) bitted identically for the tumbler assemblies 71 but differently for the tumbler assembly 88 of FIG. 6. The bitting for the tumbler assembly 88 would be such as to produce axial movement thereof into an axial position aligning the auxiliary split line 94 between the driver pin 77 and the master pin 89 and the shear line 62 and a relative rotational position aligning the transverse ridge 79 on the driver pin 77 with its associated chordal groove 66. It will be appreciated in this case that master key security can be enhanced by providing different rotational orientations for the transverse ridge 79 on the driver pin 77 actuated by the master key and the transverse ridge 91 on the master pin 89 operated by the change key. It will be further appreciated that with the plug 32a in a locked position, engagement between the limit tabs 76 on the pin tumblers 72 and the limit slots 64 in the plug 32a maintains a rotational orientation for the pin tumblers 72 within a range that will insure proper engagement thereof with a bitted portion of an inserted key even in the unlikely absence of a coupling between any pair of driver and tumbler pins.

Figure 1:
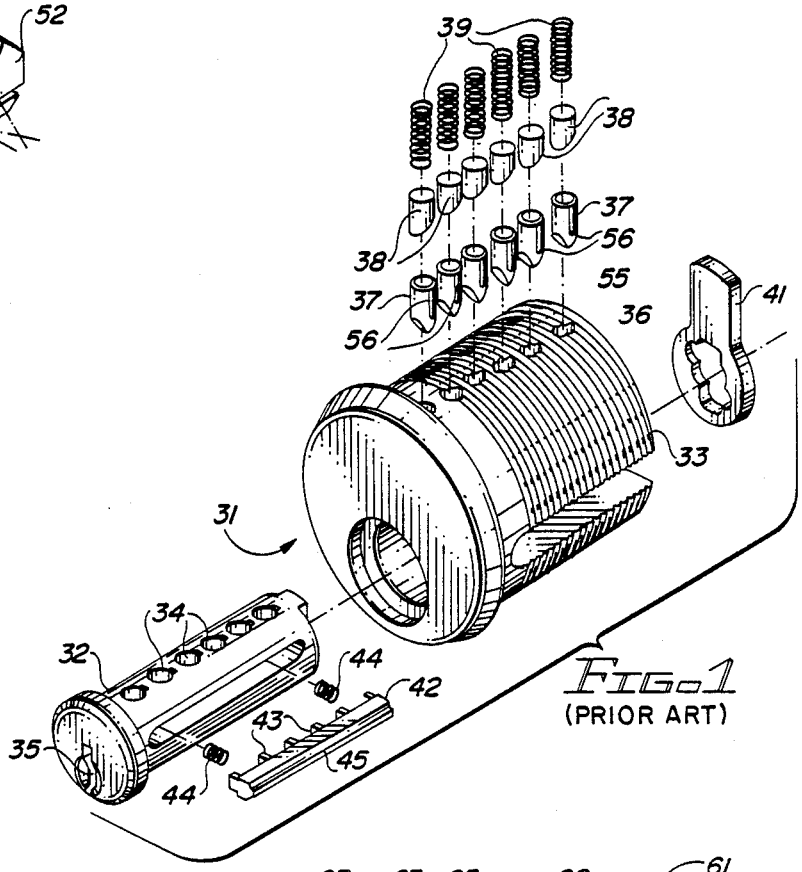
FIG. 1 (PRIOR ART)
FIG. 1 is a schematic perspective view of a conventional cylinder lock.
Figure 16:
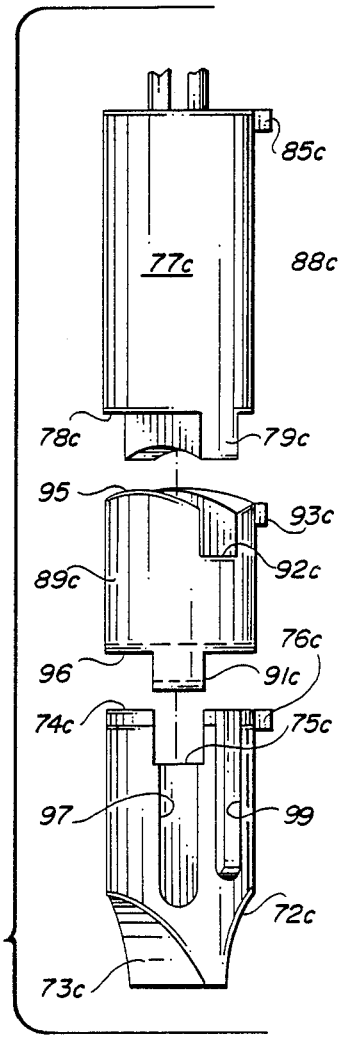
FIG. 16 is an exploded view of a modified tumbler assembly including a master pin.
Figure 17:
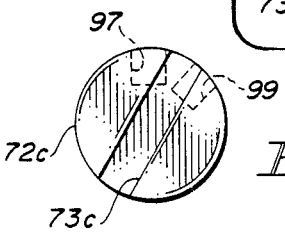
FIG. 17 is a bottom view of the tumbler assembly shown in FIG. 16.

In a preferred embodiment, the cylinder lock 61 is provided with the sidebar fence 42 shown in FIG. 1, and with a modified tumbler assembly 88c shown in FIGS. 16 and 17. The tumbler assembly 88c includes a master pin 89c disposed between a driver pin 77c and a pin tumbler 72c. As shown, transverse ridges 79c and 91c on, respectively, bottom ends of the driver pin 77c and the master pin 89c are provided with downwardly facing arcuate surfaces that conform to the outer surface of the plug 32a. Also, the master pin 89c has an upper convex surface 95 that engages a planar lower surface 78c of the driver pin 77c and a lower surface 96 that engages a convex top surface 74c of the pin tumbler 72c. Formed on an outer surface of the pin tumbler 72c are a pair of circumferentially spaced apart, longitudinally disposed slots 97, 99 each of which can be aligned to receive one of the legs 43 of the sidebar 42. Upon engagement of the pin tumbler wedge shaped end 73c with a properly bitted change key, the assembly 89c is moved into a predetermined releasing position in which split line between the pin tumbler 72c and the master pin 89c is axially aligned with the radial shear line 62, the transverse slot 75c and transverse ridge 91c are aligned with a chordal groove 66, and the longitudinal slot 97 is aligned with a leg 43 of the sidebar 42 to permit rotation of the plug 32a. Conversely, engagement of the pin tumbler end 73c with a properly bitted master key moves the assembly 88c into a given releasing portion in which a split line between the driver pin 77c and the master pin 89c is aligned with the radial shear line 62, the transverse slot 92c and the transverse ridge 79c are aligned with a chordal groove 66, and the longitudinal slot 99 is aligned with the same leg 43 of the sidebar 42 to again allow rotation of the plug 32a. Thus, the assembly 88c requires three distinct shearing alignments when operated by a change key and three different shearing alignments when operated by a master key. During movement between open and locked positions of the plug 32a, the conforming surfaces of its outer surface and either of the concave ridges 79c and 91c retains it in a rotational position aligned with a chordal groove 66. Thus, recoupling of either the pin tumbler 72c and the master pin 89c or the driver pin 77c and the master pin 89 are further insured.

Illustrated in FIGS. 19 and 20 is a modified driver pin 101 for use with the lock 61 shown in FIG. 6. The driver pin 101 is similar to the driver pin 77 shown in FIG. 9 having a transverse slot 102 for coupling to either a master pin or a pin tumbler. However, instead of a single limit tab, the driver pin 101 has three limit tabs 103, 104, and 105 distributed around its circumference. For any given driver pin, the required circumferential spacing between its limit tab and its bottom end coupling ridge will depend upon whether its rotational shear is to be provided by a center, right or left-handed bitting. For example, for a center bitting, the limit tab 103 displaced 90° from the coupling ridge 102 would be required. Conversely, for right or left handed cut bittings, respectively, either the limit tab 104 or 105 displaced from the coupling ridge 102 by, for example, 105° or 75° would be required. During use of the driver pin 101, the limit tab 103, 104 or 105 required for the given tumblerway is determined. Next, the two unwanted limit tabs are removed by, for example, a file before the driver pin 101 is assembled into a lock. Thus, for example, if the pin tumbler for a given tumblerway is to be operated by a center cut bitting, the driver pin 101 assembled into that tumblerway would first have the limit tabs 104 and 105 removed. Because of the plural limit tabs 103–105, the inventory of required driver pins required for any lock is reduced by two-thirds. The use of the driver pin 101 offers particular advantages during the field servicing of locks. It will be obvious that the multiple removable limit tab structure shown for the driver pin 101 in FIGS. 19 and 20 can be used in the same manner with master pins.

FIGS. 21 and 22 illustrate another lock series embodiment that substantially increases the number of key changes that are available for a given series of locks. The cylinder lock 107 of FIG. 21 includes a shell 108 and a plug 109 that together form a plurality of longitudinally uniformly spaced apart tumblerways 111–115. Disposed in each of the tumblerways 111–115 are a driver pin and a pin tumbler. Insertion of a properly bitted key 116 into the plug 109 moves the pins in each tumblerway 111–115 into shear positions as shown in FIG. 21 permitting rotation of the plug 109 within the shell 108 in the conventional manner.

FIG. 22 illustrates a cylinder lock 107a substantially identical to the lock 107 also having a plug 109a retained within a cylinder 108a. However, in this case, the longitudinal spacing of pin tumblerways 111a–115a is not uniform. As shown, the longitudinal spacing between the tumblerways 112a–114a is uniform and identical to that between all of the pinways 111–115 of the lock 107. However, the spacing between the tumblerways 111a and 112a and between the tumblerways 114a and 115a is slightly increased. The driver pins and pin tumblers in the lock 107a are identical to those of the lock 107 so as to require identical axial positioning for shear. As shown in FIG. 22, however, entry of the proper key 116 for the lock 107 into the lock 107a fails to provide axial shear positions for the pins in the tumblerways 111a and 115a thereby rendering the key incapable of rotating the plug 109a within the cylinder 108a.

Operation of the lock 107a requires a modified key (not shown) having longitudinally spaced bittings that correspond in position to non-uniformly spaced tumblerways 111a–115a. It will be obvious that the many combinations of possible non-uniform longitudinal spacing greatly increases the number of key changes possible in a given lock series.

Figure 23:
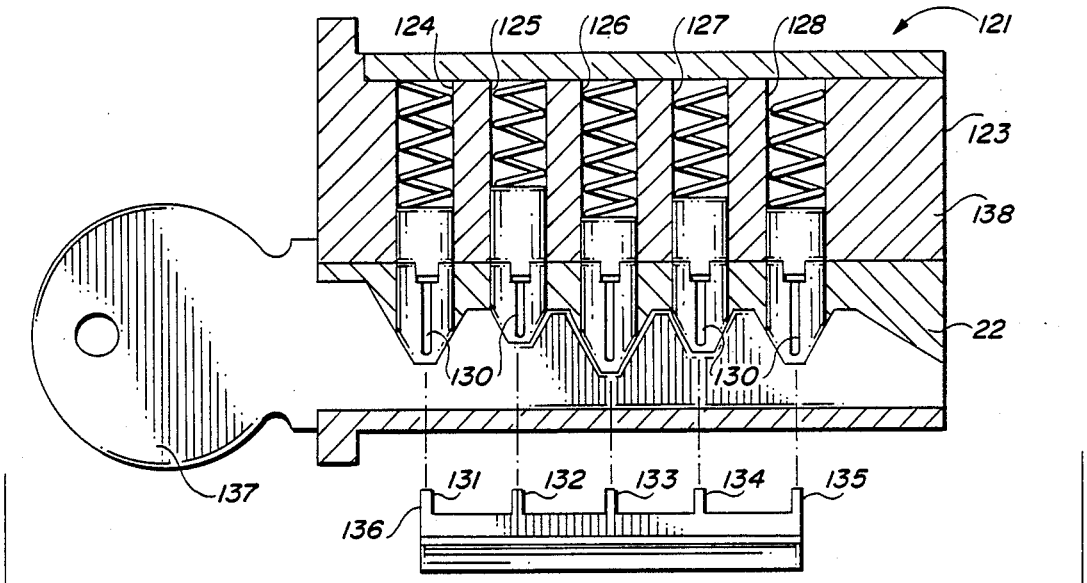
FIG. 23 is a schematic cross-sectional view of another cylinder lock embodiment with a detached fence member.
Figure 24:
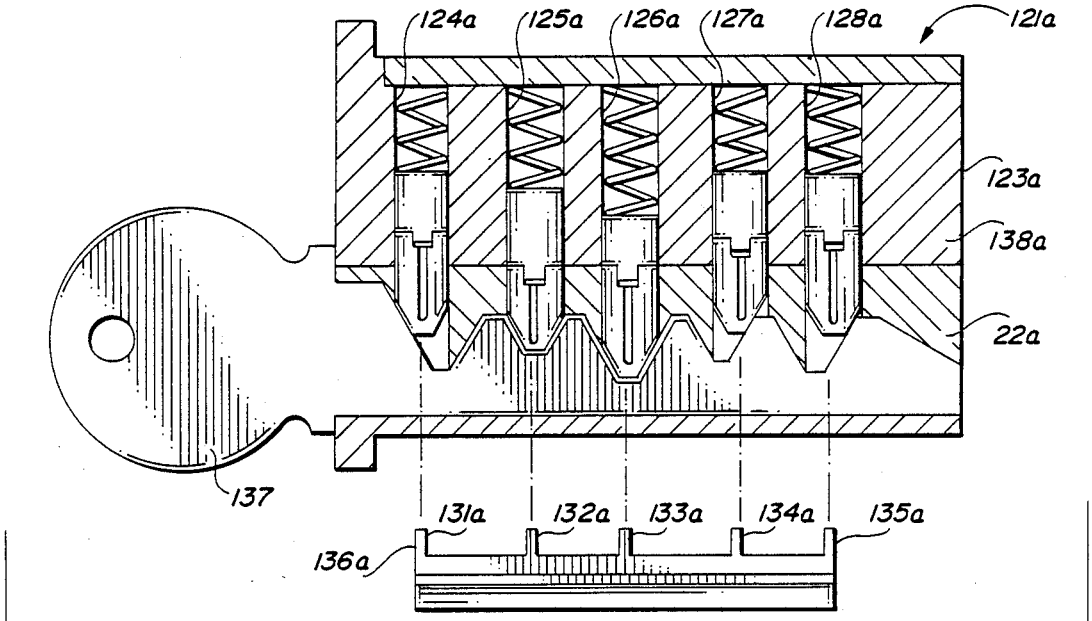
FIG. 24 is a schematic cross-sectional view of a modification of the lock shown in FIG. 23.

FIGS. 23 and 24 illustrate a lock series embodiment similar to that shown in FIGS. 21 and 22 but employing a sidebar fence of the type shown in FIG. 1. A cylinder lock 121 of FIG. 23 includes a plug 122 rotatably mounted in a shell 123 and defining therewith a plurality of longitudinally uniformly spaced apart tumblerways 124–128. Disposed in each of the tumblerways 124–128 are a driver pin and a pin tumbler of the general type shown in FIGS. 16 and 17. Longitudinal slots 130 in the pin tumblers are positioned to receive leg projections 131–135 on a sidebar fence 136 of the type shown in FIG. 1. Entering of a properly bitted key 137 into the plug 122 moves the pins in each of the tumblerways 124–128 into axial positions that provide align split lines therebetween with a radial shear line 138 between the shell 123 and the plug 122. In addition, the key 137 moves the pin tumblers in each of the tumblerways 124–128 into rotational positions wherein their longitudinal slots 130 are aligned with the uniformly spaced apart projections 131–135 of the fence 136. Thus, the key 137 can be used to rotate the plug 122 into an open position within the cylinder 123.

The cylinder lock 121a shown in FIG. 24 is substantially identical to the lock 121 also having a plug 122a rotatably mounted in a shell 123a and defining therewith a plurality of longitudinally spaced apart tumblerways 124a–128a. Disposed in each of the tumblerways 124a–128a are driver pins and pin tumblers identical to those in the tumblerways 124–128 of the lock 121. However, in the lock 121a the spacing between the tumblerways 125a and 126a, and the tumblerways 127a and 128a are identical to the uniform spacing between each pair of the tumblerways 124–128 of the lock 121 while the spacing between the tumblerways 124a and 125a and the tumblerways 126a and 127a have been increased. Similarly, the spacing between the projections 131a and 132a and the projections 133a and 134a on the fence 136a have been increased to provide a non-uniform longitudinal spacing that corresponds to the spacing between the tumblerways 124a–128a. Entry of the proper key 137 for the lock 121 into the plug 122a produces rotational and axial shear positions for the pins in the tumblerways 125a and 126a but fails to provide shear positions for the pins in the tumblerways 124a, 127a and 128a. Accordingly, a modified key (not shown) having longitudinally spaced apart bittings corresponding to the spacing between the non-uniformly spaced apart tumblerways 124a–128a, is required to operate the lock 121a. Again, the provision of different and non-uniform longitudinal spacing between tumblerways and fence projections greatly increases the number of key changes available for a given lock series.

FIGS. 25 and 26 illustrate another key embodiment for use with a lock of the type shown in FIG. 6. A key 141 includes a nose portion 142 and a partially shown central portion 143 that defines a center cut bit 144 for operating the pins in the innermost tumblerway of a lock. Formed on the nose portion 142 are longitudinally spaced apart surfaces 145, 146 having oppositely directed transverse angular orientation. For example, the surface 145 has a angular orientation corresponding to a left-handed bitting cut that will produce counter-clockwise rotation of a pin while the surface 146 has an angular orientation corresponding to a right-handed bitting cut that will produce clockwise rotation. As shown in FIG. 27 a pin tumbler 148 located in an innermost tumblerway is adapted to be maintained in a central rotational shear position by the center cut bit 144. Upon removal of the nose portion 142 from a plug (not shown), the pin tumbler 148 is rotated from its original central position first into a counter-clockwise position by the surface 145 and then into a clockwise position by the surface 146 as shown in FIG. 28. Obviously, opposite directions of rotation and similar clockwise and counter-clockwise positioning will be experienced sequentially by each pin tumbler in a lock as the nose portion 142 is removed. In the event that a driver pin 77 (FIG. 9) has inadvertently failed to reach a rotational alignment wherein its transverse ridge 79 can re-enter the transverse slot 75 of a pin tumbler 72, the oppositely directed rotations of the pin tumbler 148 produced by the key surfaces 145, 146 will assure a rotational alignment and consequent recoupling of all pairs of pin tumblers and driver pins during removal of the key 141.

FIG. 29 illustrates another key embodiment in which a key 151 has a nose portion 152 and a central portion 153 having an innermost lefthanded bitting cut 154. As shown FIG. 30, removal of the key 151 from a plug will sequentially produce rotation of each retained pin tumbler 156 into sequential counter-clockwise and clockwise positions. Thus, rotational alignment between and consequent recoupling of all pairs of pin tumblers and driver pins again is insured.

Obviously, many modifications and variations of the present invention are possible in light of the above teachings. It is to be understood, therefore, that the invention can be practiced otherwise than as specifically described.

What is claimed:

1. In a lock having a cylindrical shell, a plug rotatable relative to said shell along a shear line between locked and unlocked positions, said shell and said plug having holes therein coaxially aligned in said locked position to define a plurality of tumblerways, a tumbler assembly disposed in each of said tumblerways and being separable along at least one split line, axial bias means normally biasing each of said tumbler assemblies in an axial direction to a position wherein a said split line is not in alignment with said shear line thereby preventing relative rotation of said plug from said locked position, and means defining a keyway for receiving a proper key to move each of said tumbler assemblies axially in opposition to said axial bias means and to a position wherein a said split line thereof is generally aligned with said shear line to permit said plug to be rotated from its locked to its unlocked position, the improvement comprising:

at least one of said tumbler assemblies comprising a pin tumbler supported for rotational movement about its axis within one of said tumblerways, a driver pin, coupling means releasably coupling said driver pin to said pin tumbler for rotational movement of said driver pin about its axis in response to said rotational movement of said pin tumbler, said coupling means at least partially defining said split line along which said pin tumbler and said driver may separate when said one tumbler assembly is axially and rotationally positioned relative to said plug and said shell in a predetermined releasing position wherein said split line is aligned with said shear line, means on said pin tumbler for positioning said one pin tumbler assembly in said releasing position in response to engagement with a proper key in said keyway; and wherein said driver pin comprises an arcuate bottom surface substantially conforming to and engaging the outer surface of said plug during said rotation thereof, said engagement between said plug and said arcuate bottom surface maintaining a given rotational orientation of said driver pin during said rotation of said plug.

2. A lock according to claim 1 and including a fence member retained by said plug, biased into engagement with said shell and blockingly associated with said pin tumbler; said fence being shaped and arranged such that rotation of said pin tumbler into said predetermined releasing position allows said fence to clear said shear line.

3. A lock according to claim 2 wherein said pin tumbler defines a change gate for receiving a projection of said fence when in said predetermined releasing position, and said fence and said shell define engaging cam surfaces for forcing said projection of said fence into said gate in response to relative rotational movement between said plug and said shell.

4. A lock according to claim 3 wherein said coupling means comprises a master pin coupled between said driver and said pin tumbler and at least partially defining therewith an auxiliary split along which said pin tumbler and said master pin may separate when said one tumbler assembly is axially and rotationally positioned relative to said plug and said shell in a given releasing position different than said predetermined releasing portion and said auxiliary split line is aligned with said shear line.

5. A lock according to claim 4 wherein said pin tumbler further defines a master gate spaced from said change gate and adapted to receive said projection of said fence when in said given releasing position.

6. A lock according to claim 1 including tumbler limit means for limiting rotational movement of said pin tumbler in said one tumblerway.

7. A lock according to claim 6 wherein said tumbler limit means comprises a tab projecting transversely from said pin tumbler and received by said slot.

* * * * *